United States Patent [19]

Faust et al.

[11] 4,090,046

[45] May 16, 1978

[54] KEY OPERATED SWITCH FOR AUTOMOBILE ALARM OR THE LIKE

[75] Inventors: James H. Faust, Cicero; Billy J. Biagioli, Chicago, both of Ill.

[73] Assignee: A.B.C. Auto Alarms, Inc., Forest Park, Ill.

[21] Appl. No.: 808,167

[22] Filed: Jun. 20, 1977

[51] Int. Cl.[2] ..... H01H 27/06

[52] U.S. Cl. ..... 200/44; 200/15; 200/155 R; 200/262; 200/275

[58] Field of Search ..... 200/11 B, 15, 61.64, 200/44, 155 R, 244, 254, 273, 275

[56] References Cited

U.S. PATENT DOCUMENTS

| | | | |
|---|---|---|---|
| 648,951 | 5/1900 | Hanson | 200/15 |
| 931,911 | 8/1909 | York | 200/273 |
| 1,709,008 | 4/1929 | Ennis et al. | 200/15 X |
| 2,778,891 | 1/1957 | Jacobi | 200/44 X |

FOREIGN PATENT DOCUMENTS

| | | | |
|---|---|---|---|
| 320 of | 1911 | United Kingdom | 200/15 |

*Primary Examiner*—Stephen Marcus

*Attorney, Agent, or Firm*—Silverman, Cass & Singer, Ltd.

[57] ABSTRACT

An electric key-operated switch adapted to be mounted on the exterior of a vehicle or structure to arm or disarm an alarm system. A key is to be rotated in a cylinder between two positions, each of which controls a separate circuit that is normally open when the contact rotor carried by the cylinder is not engaged with contacts connected to the respective circuit. The invention provides more positive electrical engagement and a novel structure for economically adjusting the limits of positions of the contact rotor so that the key may readily be inserted and removed.

9 Claims, 5 Drawing Figures

KEY OPERATED SWITCH FOR AUTOMOBILE ALARM OR THE LIKE

FIELD AND BACKGROUND OF THE INVENTION

The field of the invention is key operated switches for alarm systems and the invention is directed to such a switch which is designed to control two electrical circuits.

Alarm systems which use cylinder locks actuated by barrel keys are common especially for vehicles. The lock is of the so-called "Ace" type in which the key is a cylindrical instrument having varied recesses ground along its forward axial end adapted to cooperate with suitable pins in the receiving structure and characterized by the presence of a radial tooth which includes interior and exterior portions that must be inserted into the lock. The lock has a planar surface face plate and this plate presents an annular slot to its exterior with two radially outwardly extending short notches also in the face plate spaced about 90° apart adapted to accommodate the tooth of the key during insertion and removal. The care of the lock cylinder also has a slot to be engaged by the interior part of the tooth.

In use, the key is inserted into the annular slot with the tooth aligned with one of the outer notches and the core notch and turned to bring the tooth and core notch into alignment with the second of the outer notches at which point the key can be removed. No other manipulation is possible. To place the switch in its former condition the key must be inserted with the tooth entering the second notch and reversed in rotation to the former position at which point the key can be removed.

This arrangement is common and well-known.

The invention herein concerns itself with two problems, namely constructing the electrical contacting means of the switch so that same will have perfect alignment in both conditions so that the key can be readily inserted and removed; and providing positive contact for the electrical contacting means.

In the process of achieving these ends a novel rotor and blade arrangement has been achieved which is efficient and quite simple.

The first mentioned problem arises because the limits of this type of switch must be controlled accurately. Some switches used detents which are not reliable, especially where the contact pressures are relatively high. This is true for vehicle alarm systems which often are connected into the starter control or into a main d.c. battery line. Other switches use expensive stop members requiring relatively high degrees of skill in the workmen assembling the same. In a small volume factory this makes the switches expensive.

The invention solves this quite simply by providing a stop member directly on opposite edges of the rotor adapted to engage with respective parts of the switch. Since each stop member is a simple sheet metal tab welded to the rotor or integral with the rotor, adjustment is facilitated by merely trimming the sheet metal of the tab without disassembling the switch.

The second problem arises because many alarm systems must be capable of being turned on and off a great many times and be capable of carrying considerable current. Especially in switches which are of the double pole double throw type, the electrical contact is established by a single flat blade engaging face to face with another flat blade. The contact thus established is not as good as could be achieved, for example, by the classical single blade robust knife switch which enters between a pair of juxtaposed contacts. There is no space for this latter type of switch in normal terminal boxes which are used for this type of alarm switch; such switches are normally used in circuits which carry high voltage and hence the juxtaposed contacts are not electrically independent of one another; such a structure would be considered too expensive for a switch of the type involved herein.

The invention solves this problem by a novel structure to be described which is very economical and yet efficient. It provides high current carrying capacity.

The prior art alarm switch which the invention is designed to supersede was likewise of a type to be mounted in a junction box of conventional construction. There were four contacts located 90° apart and the rotor of the switch was coaxial with the lock cylinder and of elongate construction, comprising a metal member insulatedly mounted at its center on the end of the cylinder. The oppositely extending arms of the rotor each had a contact end which could bridge between each pair of diametrically disposed contacts. Each circuit was connected to a pair of such oppositely disposed contacts. The contact was established only as face to face and hence there was only that amount of pressure that could be achieved by the bent nature of the members establishing the contact coming into engagement with one another and being flexed by the physical engagement. The limits of rotation of the key were established by the cooperation between a segment of metal carried on the outer fixed shell of the cylinder and a washer with a segment-like tooth carried on the rotor. Adjustment involved proper placement of the washer relative to the shaft of the cylinder. Again the rotor of the switch had to be adjusted in its placement on the shaft of the cylinder to be able to move within the limits of the switch movement.

SUMMARY OF THE INVENTION

An alarm switch for a vehicle or the like which is adapted to control two independent circuits, each circuit being connected to a pair of spaced apart contact fingers which keep the circuit open normally but are adapted to close the circuit when a rotor member engages between the pair, the rotor member being conductive and insulatedly mounted on a shaft coaxially with the cylinder of a cylinder lock, the cylinder lock adapted to be rotated manually by means of a key moving between two positions angularly spaced from one another.

The limits of angular movement of the rotor and the key are established by means of sheet metal tabs on opposite edges of the rotor, the tabs adapted to engage the insulating supports of the contact fingers at the end of the rotary movement thereof. Adjustment of the angle of rotation is achieved by trimming the tabs.

The invention lies in the switch with the rotor and contact arrangement irrespective of the means for limiting its angular movement and additionally in the rotor and contact arrangement in combination with the use of the sheet metal tabs for establishing limits to the angular movement of the rotor.

DESCRIPTION OF THE PREFERRED EMBODIMENTS

Figure 1:
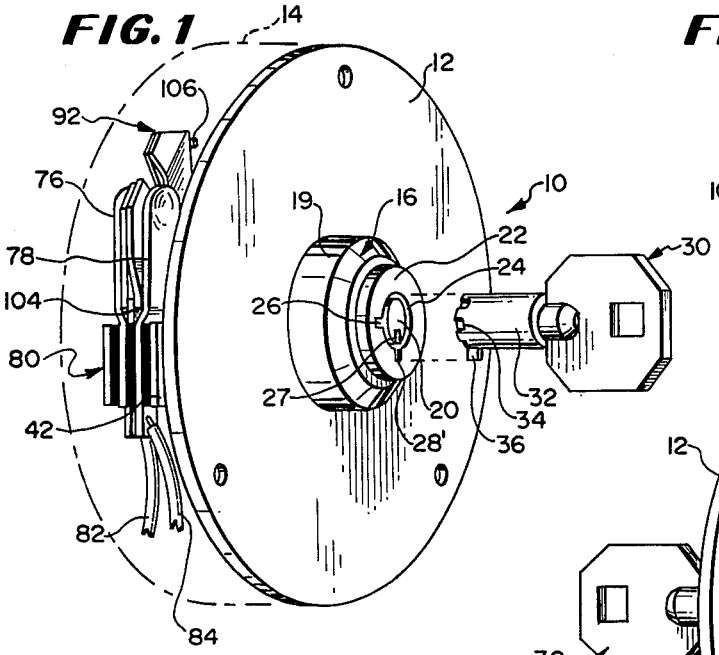
FIG. 1 is a perspective view of a key operated switch for an automobile alarm or the like taken from the front thereof and showing the barrel type key that is used therewith.

The switch of the invention is designated generally by the reference character 10 and is described herein as it is applied for use in a vehicle alarm but it should be appreciated that it could as easily be utilized in other environments which require the control of two circuits by means of a key.

The switch is mounted by suitable means on a mounting disc 12 of the type that is conventionally fastened to a junction box 14. For example, the lock 16 may have a threaded outer shell or frame 18 which is introduced into a hole in the disc 12 and clamped in place by nut 19. Thus the body or frame is fixed to the rear face of the mounting disc 12 in any suitable manner. The lock has a cylinder, only the central core 20 of which can be seen in FIG. 1. The shell 18 has a face plate 22 which is provided with a central perforation that cooperates with the axial end of the core 20 to present an annular slot 24 to the exterior of the lock 16. A pair of radially outwardly extending notches 26 and 28 are also cut in the face plate 22 connecting with the slot 24 and, in this version, spaced 90° apart. The core 20 also has a notch 27. The key 30 used with this type of lock 16 can be called a barrel key since it has a cylindrical barrel 32 as its body, the axial end having recesses 34 to cooperate with the internal pins for releasing the cylinder and having an outwardly extending radial tooth 36 adapted to be aligned with the notches 26 and 28 with an interior extension adapted to align with the notch 27.

The key 30 is used by inserting it into the slot 24 with its barrel 32 aligned with the slot. The thickness of the wall forming the barrel 32 is slightly less than the width of the slot 24 so that it can freely enter and bottom on a suitable stop (not shown). The tooth 36 must be aligned with that one of the notches 26 or 28 which is also aligned with notch 27 in order to enable the key 30 to be inserted into the lock 16. The sequence is relatively straightforward and is well-known with locks of this kind. Assuming that the lock is arranged to receive the key 30 while the cylinder is in its clockwise-most condition, the slot will accept the key 30 only when both parts of the tooth 36 are aligned with and inserted through the notch 26 but only if notch 27 is also aligned with 26. The key 30 can now be rotated 90° counterclockwise and withdrawn through the slot 24 if the tooth 36 is in perfect alignment with the notch 28. The next time the lock is to be used, the key 30 must be inserted into the slot 24 with the tooth aligned with the notch 28 and notch 27 and rotation is only capable of being effected in a clockwise direction.

This lock is used to open and close electrical circuits connected into an alarm system.

At its rear, the shell 18 has a rectangular bracket 38 fixedly secured thereto having a pair of lateral arms 40 and 42 bent at an angle and arranged to be axially spaced from the bracket so that the contact fingers (to be described) will be properly aligned with the rotor (to be described). Each of the lateral arms carries a pair of contact fingers insulatedly mounted thereon. The arm 40 has a block of insulating material 44, the base 46 of the contact finger 48, another insulating block 50, the base 52 of the contact finger 54, another insulating block 56 and a rectangular holder plate 58 all connected together to provide an assembly by means of rivets or grommets 60 that pass through all of the mentioned members and secure them tightly on the arm 40. The openings for the grommets 60 which pass through the bases 46 and 52 are insulated from the grommets either by insulating washer spacers in enlarged holes or by having these holes large enough to clear the grommets. These techniques are known and the structure need not be shown.

At the bottom ends of the bases 46 and 52 there are extensions 60 and 62 respectively, these being free of the assembly of blocks mounting the bases 46 and 52 and comprising soldering ears to which the wires 64 and 66 are connected. The ears are bendable to keep them spaced from one another. The wires 64 and 66 are part of a circuit to be controlled by the switch 10.

The fingers 48 and 54 are formed of some conductive metal having substantial resilience, such as phosphor bronze or other alloy of copper. They are mounted to the block assembly with their free ends 68 and 70 slightly spaced apart, their bodies being outwardly bent to provide the space 72 between them. The free ends 68 and 70 are rounded and the fingers are dished as at 74 with the concave portions resulting facing outwardly from one another. In this manner the edges of the juxtaposed fingers 48 and 54 are flared outwardly to present means for piloting the rotor into the space between the fingers.

As will be seen below, the inwardly facing edge 76 of the block 50, i.e., that edge which opens to the space 72 comprises stop means for the movement of the rotor.

The lateral bracket arm 42 mounts a pair of fingers 76 and 78 which are identical to the fingers 48 and 54 in all respects and are mounted on the same structure of blocks mounting the fingers 48 and 54. There is no need to describe them in detail, the block assembly being designated generally 80. The fingers 76 and 78 are connected respectively to the wires 82 and 84 in the same manner as the wires 64 and 66, these wires comprising a part of a second electrical circuit to be controlled by the switch 10. Normal condition of the fingers 76 and 78 is also spaced apart.

The rear of the cylinder of the lock 16 includes a shaft 86 which is preferably threaded and which rotates through a passageway (not shown) in the bracket 38. A nut 88 secures a washer 90 to the shaft, to which is mounted a rotor 92 the mounting comprising a suitable sandwich of holder plates, insulating blocks and grommets designated generally 94 functioning to secure the rotor 92 on a lateral edge of the washer 90 but fully insulated from the washer 90.

The rotor 92 is preferably made out of two sheet metal stampings 96 and 98 of phosphor bronze or the like of irregular polygonal configuration. In the examples illustrated (including that of FIG. 5) the shape is somewhat like a square with one corner clamped in place by the block structure 94, with the opposite corner cut off and a large central radial slot 99 extending inward from the truncated corner stopping short of the block structure 94. This configuration provides resilient blades 100 and 102 capable of flexing substantially independently without influencing one another. The slot 99 also prevents the blades from being too stiff.

As stated the rotor 92 is formed of a pair of these sheet metal stampings clamped together. Each sheet metal member 96 and 98 is formed with a substantial bend 97 extending between the corners opposite the ones previously mentioned as a result of which the rotor 92 has a rather substantial thickness greater than the space between the contact fingers such as 48 and 54. This is true notwithstanding the fact that the sheet metal from which the members 96 and 98 are formed may be extremely thin. The bends 97 are convexly outward relative one another. When the rotor 92 engages between a pair of contact fingers 48, 54 or 76,78 it forces the fingers apart, scrapes or wipes against the fingers and gives rise to substantial mechanical contact pressure as a result of which an unusually good electrical contact is made. It has been found through testing that the current handling capacity of such a contact arrangement is several times greater than the simple contact between two single members biased against one another.

Figure 3:
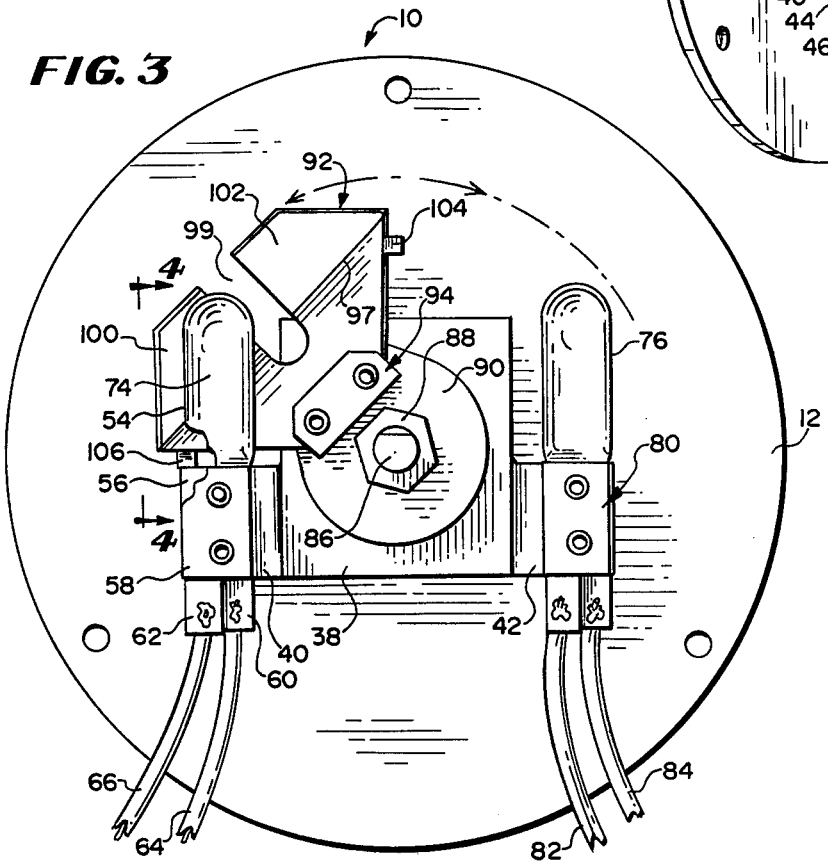
FIG. 3 is an elevational view of the rear face of the switch.

In operation, assuming that the blade 100 is at the position shown in FIG. 3, the fingers 76 and 78 are spaced apart and the circuit represented by the wires 82 and 84 is open. The blade 102 is free. The blade 100 is forced between the fingers 48 and 54; hence the fingers are electrically bridged and the circuit represented by the wires 64 and 66 is closed. If the key 30 is inserted into the lock 16 and turned through 90° the blade 100 will leave the position between the fingers 48 and 54, pass through the circumferential space between the separate pairs of fingers at which point the both circuits 64,66 and 82,84 will be open. At the end of the clockwise movement which follows the path described by the arcuate broken line of FIG. 3, the blade 102 will force itself into engagement between the fingers 76 and 78 thereby closing the circuit of the wires 82 and 84, leaving the circuit of the wires 64 and 66 open. The reverse will be accomplished by rotating the key 30 in the opposite direction.

Figure 4:
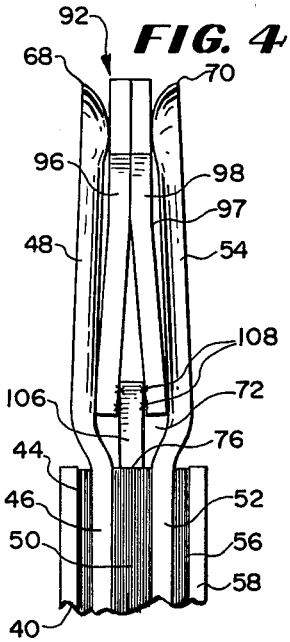
FIG. 4 is a fragmentary sectional view with parts in elevation taken generally along the line 4—4 of FIG. 3 and in the direction indicated.

The rotor 92 has a pair of metal tabs 104 and 106 which are connected with the blades 100 and 102, respectively, these tabs being disposed on what would be considered the leading and trailing edges of the rotor 92 considering that these edges are generally radial relative to the axis of the shaft 86. The tabs may be formed out of the same metal as the blades and welded in place between them as indicated at 108 in FIG. 4 or it could be integral with one of the sheet metal members forming the blades. Since each is located precisely in the center between the blades, the tabs 102 and 104 align with the center insulating blocks such as 50 and will cooperate with the block edges such as 76 to form precise stop means for limiting the rotary movement of the rotor 92 in either direction. The tabs 104 and 106 can initially be deliberately made slightly longer than needed. When the switch 10 is assembled and tested with a key, if the key cannot be inserted or withdrawn in both of its two positions, the tabs 104 and 106 are easily trimmed by means of tinsnips. This requires no skill and no disassembly of the switch.

Figure 5:
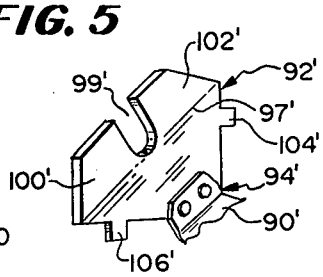
FIG. 5 is a fragmentary perspective view of a modified form of rotor of the invention.
Figure 2:
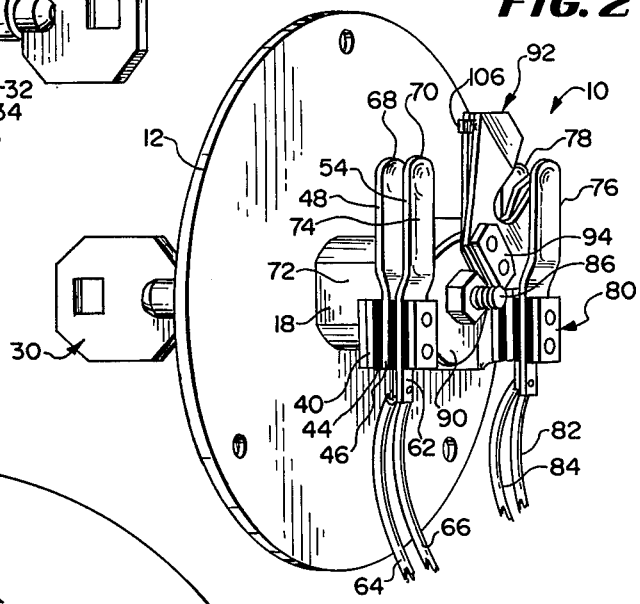
FIG. 2 is a perspective view of the switch of FIG. 1 but from the rear thereof.

In FIG. 5 there is illustrated a rotor 92' which is formed of only a single stamping of sheet metal, again bent in the center to bow out and configured to form the bend 97', the slot 99' and the two blades 100' and 102'. (The reference characters are the same as those of the previously described embodiment for equivalent parts, but primed.) The single sheet metal member is adapted to be secured by an insulating clamping or mounting assembly 94' to a washer 90' and function in the same manner as previously explained. Here the tabs 104' and 106' are integral with the single sheet metal member.

Variations are capable of being made in the constructional details and configurations of the parts without departing from the spirit or scope of the invention as defined in the appended claims.

What it is desired to secure by Letters Patent of the U.S. is:

1. An electric key-operated switch adapted to be mounted on a structure for controlling an alarm or the like having two electrical circuits, said switch comprising:

A. means for mounting a lock on said structure, said lock having a fixed part and a rotary part adapted to rotate on an axis between two positions angularly spaced from one another less than a full revolution, the lock being actuated by a key that rotates in the fixed part between the two positions relative thereto and is removable from the lock at said positions only, B. the rotary part having a rotor mounted thereon at a location radially spaced from the axis comprising
   i. an irregular geometric configuration metal structure insulatedly connected with the rotary part and insulated from the fixed part,
   ii. the metal of the rotor being resilient and having a central generally radially extending slot serving to divide at least the radially outward part of the rotor into two blades,
   iii. the blades being laterally deformed out of plane of rotation of the rotor and the blades being respectively at circumferential ends of the rotor, each blade presenting itself as a leading edge of the rotor when the rotor is rotated in one direction,
   iv. the rotor adapted to move in an arcuate path simultaneously with the rotation of the key and being driven by the key, there being a mechanical coupling between the key and the rotary part when the proper key is inserted into the lock, such arcuate path acting to carry the blades into two different respective positions at the opposite ends of said path, C. a bracket mounted on the fixed part and carrying two pairs of contact fingers spaced apart at locations, respectively which intersect the arcuate paths at said opposite ends thereof, each pair of fingers comprising:
   i. juxtaposed resilient metal members normally spaced apart when a blade is not interposed between them,
   ii. said metal members having their peripheries outwardly flared to provide pilot means for the entry of a blade,
   iii. the fingers being mounted on said bracket insulatingly, and
   iv. said fingers having means for electrically connecting them into an electrical circuit which is adapted to be open when the blade is not engaged between the fingers but closed when a blade is disposed between the fingers, D. the movement of the rotor from one position to the other being effective to withdraw one blade from one pair of fingers as it starts the movement and to force the other blade to enter between the other pair of fingers as it completes the movement, the withdrawal being complete before the entry is commenced, and E. the lock having stop means carried by the fixed and rotary parts defining the path of movement of the rotor.

2. The switch as claimed in claim 1 in which the metal structure is formed of two congruent sheet metal stampings each of which is outwardly bowed to provide the lateral deformation of the blades.

3. The switch as claimed in claim 1 in which the metal structure comprises a single sheet metal stamping.

4. The switch as claimed in claim 1 in which the contact fingers are dished with their concavities facing away from one another.

5. The switch as claimed in claim 1 in which the stop means comprise a protrusion carried on each of said rotor edges and a cooperating stop member provided adjacent each pair of fingers on said bracket.

6. The switch as claimed in claim 5 in which the protrusions are formed of sheet metal capable of being trimmed to enable accurate adjustment of said path of movement of the rotor without disassembling the switch.

7. The switch as claimed in claim 2 in which the stop means comprise a protrusion carried on each of said rotor edges connected between the stampings and said protrusions are aligned with the spaces between the fingers, in which there is a cooperating stop member on the bracket in each of said spaces between the fingers.

8. The switch as claimed in claim 7 in which the protrusions are metal and the stop members are of insulating material.

9. The switch as claimed in claim 3 in which the stop means comprise a protrusion integral with each of said rotor edges and a cooperating stop member of insulating material provided between each pair of fingers on said bracket, the protrusions adapted to be trimmed to enable accurate adjustment of said path of movement of the rotor without disassembling said switch.

* * * * *